US005684515A

United States Patent [19]

Ho

[11] Patent Number: 5,684,515

[45] Date of Patent: Nov. 4, 1997

[54] METHOD FOR PLACING INDICIA ON SUBSTRATES HAVING AN ENAMEL BAND THEREON

[75] Inventor: Anthony C. Ho, Toledo, Ohio

[73] Assignee: Libbey-Owens-Ford Co., Toledo, Ohio

[21] Appl. No.: 576,318

[22] Filed: Dec. 21, 1995

[51] Int. Cl.[6] ..... B41J 2/01

[52] U.S. Cl. ..... 347/2; 347/100; 347/106; 427/266

[58] Field of Search ..... 347/2, 100, 106; 427/266

[56] References Cited

U.S. PATENT DOCUMENTS

| | | | |
|---|---|---|---|
| 4,503,437 | 3/1985 | Katzschner | 347/106 |
| 4,835,208 | 5/1989 | Ball | 346/99 |
| 5,083,814 | 1/1992 | Guinta et al. | 347/106 |
| 5,091,003 | 2/1992 | Boaz | 347/100 |
| 5,326,591 | 7/1994 | Roberts | 427/162 |
| 5,328,753 | 7/1994 | Boaz | 428/40 |
| 5,407,474 | 4/1995 | Airey | 347/106 |
| 5,449,426 | 9/1995 | Lin | 347/106 |

FOREIGN PATENT DOCUMENTS

| | | |
|---|---|---|
| 433137 A2 | 12/1990 | European Pat. Off. . |
| 433137 A3 | 12/1990 | European Pat. Off. . |
| 3800633 A1 | 7/1989 | Germany . |
| 3834674 A1 | 4/1990 | Germany . |

*Primary Examiner*—Valerie Lund
*Attorney, Agent, or Firm*—Marshall & Melhorn

[57] ABSTRACT

Indicia is affixed to an enamel band on a substrate. An ink suitable for use in known ink jet printers containing inorganic pigments and no frits is applied in a predetermined, easily changeable, pattern to the surface of an enamel band found on a substrate such as plastic or glass. Subsequently the substrate having the enamel band and ink thereon may be heated to a temperature sufficient to cause the frits in the enamel band to adhere to the inorganic pigment in the ink to form permanent opaque indicia on the enamel band in the form of a separate and distinct layer.

17 Claims, 1 Drawing Sheet

METHOD FOR PLACING INDICIA ON SUBSTRATES HAVING AN ENAMEL BAND THEREON

BACKGROUND OF THE INVENTION

1. Field of the Invention

The present invention relates generally to a method for placing indicia on enamel bands found on various substrates such as glass and plastic. More particularly, the invention is directed to the use of an ink jet printing composition containing inorganic pigments, not requiring a frit or flux, in an ink jet printing process to place opaque and easily changeable indicia, such as serial numbers and the like, on the enamel band.

Most particularly, the present invention involves using a known ink containing inorganic titania pigments in an ink jet printer to place opaque indicia in a separate and distinct layer on a ceramic enamel band found on a substrate. The indicia may be temporary or permanent. If the indicia is to be permanent, a heating step is used to "cure" the pigment.

2. Description of the Related Art

It is common and well known in the automotive and architectural glass industries to have glass with an enamel band applied thereto for masking a portion of the structure to which the glazing is applied. The enamel band hides otherwise visible features of the structure in which the windshield or structural glass is used.

However, the enamel band is also applied to an area of the glass where it is desired to place either temporary or permanent indicia regarding the manufacturing process, such as serial numbers, logos, and the like. This has caused a problem in the art because the enamel band, whether a black ceramic enamel band, or other type, is normally silk screened onto the substrate to which it is being applied. For the purposes of serial numbering, for example, each change in number would require a new silk screen, which would be prohibitively expensive.

Ball, U.S. Pat. No. 4,835,208, discloses the use of a non-contact ink jet printer for placing surface indicia directly on glass, and a hot melt ink composition for use therein. However, this patent teaches away from a curing step because this would cause the hot melt ink to remelt and run. Thus, such marking composition not only is for use directly on glass, rather than on an enamel band, but is not suitable for use when a curing step is to be used.

Boaz, U.S. Pat. No. 5,091,003, discloses the use of a low viscosity silver nitrate-containing thermal diffusion ink composition which can be applied directly to the surface of a glass article by a non-contact ink jet printer, and the glass subsequently reheated. However, such is not usable on a ceramic enamel band because the invention therein depends on ion diffusion between the ink and the glass to stain the glass in the area of the indicia, and make the indicia readable.

Airey, U.S. Pat. No. 5,407,474, discloses a pigmented ink usable in an ink jet printer in which the maximum particle size of the pigment is sufficiently small not to block the nozzles or the filters of the printer, and the particle size range is sufficiently narrow for the ink to have a low viscosity for the printer to operate. While this ink is suitable for printing on glass or a ceramic enamel band, it is unnecessarily expensive for the purposes of the present invention, because it contains, in addition to the organic pigment, a frit, or flux, which is not needed in the process of the present invention, as will be explained below. The patent to Airey also teaches distinctly away from the titania based pigments which provide the desired opacity to provide a white marking on a black enamel band.

Thus, those skilled in the art of automotive and structural glass continued to search for a solution to the problem of placing easily readable and easily changeable indicia on enamel bands present on substrates.

SUMMARY OF THE INVENTION

In accordance with the present invention, a known ink composition is used in a novel application to place an opaque indicia on an enamel band on an architectural or automotive substrate. It has been discovered that indicia may be temporarily or permanently affixed to such enamel band by a method or process comprising the steps of: first, providing an architectural or automotive substrate, including a surface having an enamel band applied thereto; secondly, applying to the enamel band, in a predetermined pattern, with an ink jet printer, an ink jet composition including an inorganic pigment, and preferably lacking a frit or flux, and; third, heating, if desired, the substrate having the ink thereon to a temperature and for a time sufficient to cause the flux from the enamel band to soften and adhere, or stick to, the inorganic pigments from the ink to cause an opaque, distinct, layer of the pigment to be deposited on the enamel band.

The process for permanently affixing indicia to the enamel band is particularly useful either for placing permanent identification, such as production dates, lot numbers, sequential numeral codes and the like onto substrates, or if the heating step is omitted, for providing temporary indicia of such types, or other types, on the substrate.

In one embodiment of the present invention, an ink jet composition including an inorganic pigment, but lacking a frit, is applied using a known ink jet printer to an enamel band carried by a glass substrate.

In another embodiment of the present invention, an ink jet composition, including titania inorganic pigment, and lacking a frit, is applied to an enamel band carried by a plastic substrate.

In another embodiment of the present invention, an ink jet composition including inorganic pigments, but lacking a frit, is applied to an enamel band carried by a piece of architectural glass.

In still another embodiment of the present invention, an ink jet composition including between 3 and 7% by weight of 1-methoxy-2-propanol, between 5 and 10% by weight of titanium dioxide, between 0% and 60% by weight of acrylic resin, between 20 and 35% by weight of methanol, between 20 and 35% by weight of 2-butanone, and between 1 and 3% by weight of N-methyl-2-pyrrolidone is applied to a ceramic enamel band contained or carried by a glass substrate, the glass substrate later heated to a predetermined temperature and bent into a desired shape.

Thus, it is an object of the present invention to provide a method for marking indicia on enamel paint bands carried by automotive or architectural substrates of various types.

Further objects and advantages of this invention will be apparent from the following description and dependent claims, reference being made to the accompanying drawings forming a part of the specification, wherein like reference characters designate corresponding parts in the several views.

It is to be understood that the present invention is not limited in its application to the details of construction and arrangement of parts illustrated in the accompanying drawings, since the invention is capable of other embodiments, and of being practiced or carried out in various ways within the scope of the claims. Also, it is to be understood that the phraseology and terminology employed herein is for the purpose of description, and not of limitation.

DESCRIPTION OF THE PREFERRED EMBODIMENTS

It is desired to apply ink jet compositions to automotive or architectural substrates, such as glass, or polycarbonate, and the like. It was found that a standard ink jet printer and an ink jet composition of pigmented ink could be used to mark indicia on top of an unfired black ceramic enamel band on a glass substrate to be formed into a windshield.

Figure 1:
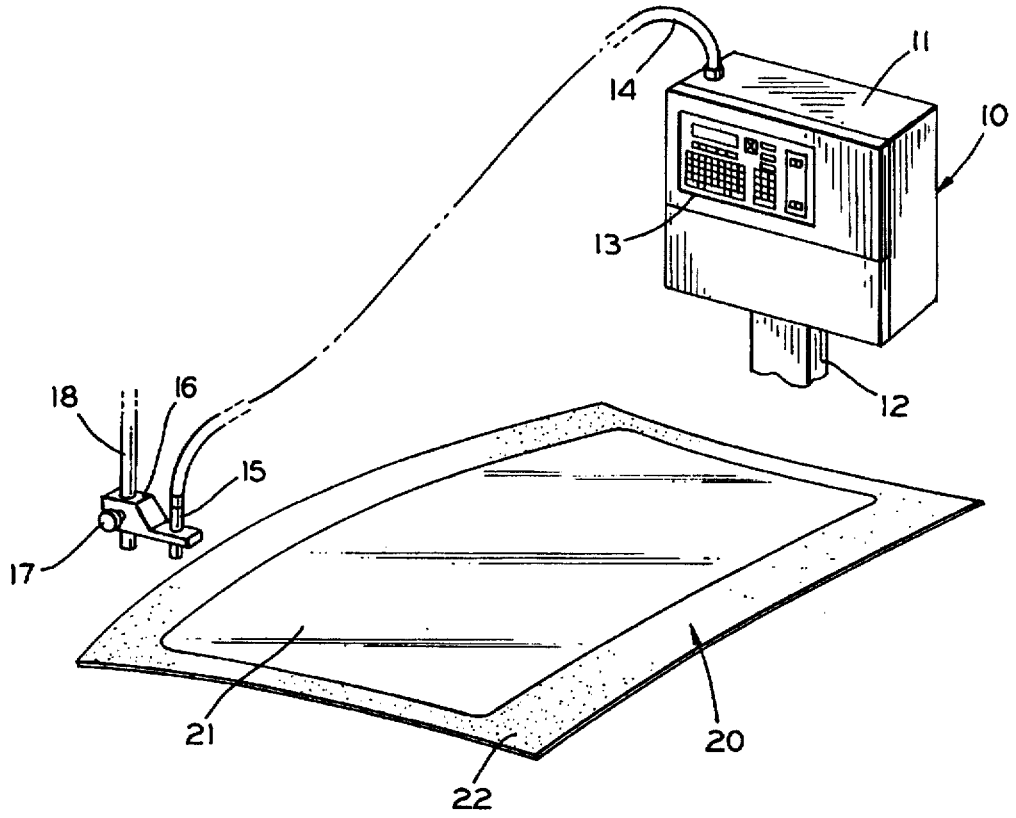
FIG. 1 is a perspective view of a construction embodying the present invention showing an ink jet head connected to an ink jet printer mechanism for applying indicia to an enamel band on a substrate in accordance with the method of the present invention.

Referring to FIG. 1, there is shown an ink jet printer, generally designated by the numeral 10, which may be a standard ink jet printer as discussed herein below. The ink jet printer 10 generally has a cabinet 11, mounted on a stand 12, which may be the stationary or roll about type. A control panel 13, well known in the art, is provided on which the operator sets the desired operating conditions. Ink is supplied from the cabinet 10 through the conduit 14 to the ink jet head 15 mounted in a known bracket 16. The bracket 16 is held by means of thumb screw 17 to arm 18.

In accordance with the invention, the arm 18 may be of a stationary type, or may be a moveable arm, such as a robotic arm, which can be programmable by means well known in the art to have the ink jet head 15 follow the curvature of a substrate as discussed herein below. The ink jet printer 10 may be of the on demand type, or a continuous ink jet printer.

In an on demand type ink jet printer, ink is fed under a desired pressure from a reservoir to a series of nozzles via valve means which control the flow of the ink through each nozzle. The valve means is typically an electro-magnetically actuated valve, notably a solenoid valve. The ink is discharged through the nozzles as discreet droplets in the desired sequence to form the required image on the substrate. Usually the nozzles are arranged in one or more series transversely to the line of movement of the substrate. Typically such printers have quick acting valves with an operating cycle time of from 1 to 5 milliseconds, feeding nozzles with orifices having diameters of from 0.01 to 0.45 mm.

For compositions which are to applied using a continuous ink jet printer, it is necessary that the composition be one which can accept an electrical charge. This is conveniently achieved by including one or more ionic or polar materials in the composition. It will seen that compositions can be chosen which can be used in either type of ink jet printer.

The ink jet printer 10, using the ink jet head 15, is shown applying indicia to a substrate, generally designated by the numeral 20. The substrate 20 may be such as a glass sheet 21 having a black ceramic enamel band 22, which has previously been applied thereto. The substrate 20 may be made of a wide range of materials, such as soda-lime-silica glass or polycarbonate. Such materials are typically used for side lights or windshields of cars. The substrate 20 may also be of any suitable type for use in architectural applications.

Figure 2:
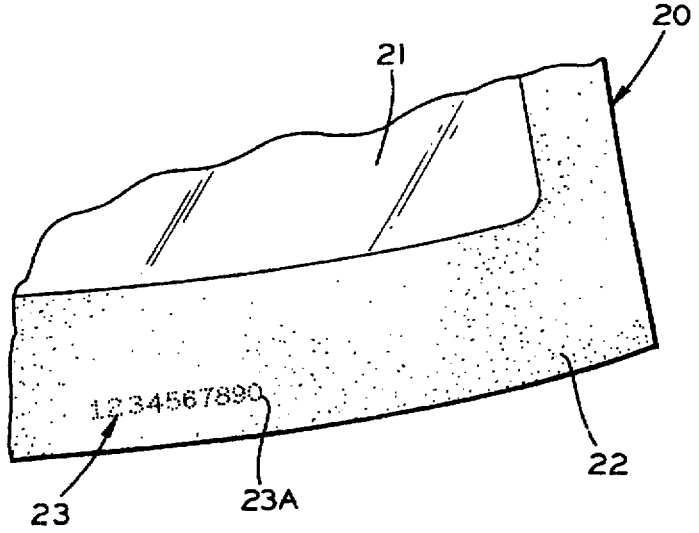
FIG. 2 is a plan view, partially broken away, showing indicia applied to a ceramic enamel band on a glass substrate.

Referring now to FIG. 2, the windshield 21 has an unfired black ceramic enamel band 22 applied to a surface thereof. As is conventional, the enamel band includes a flux or binder as a component thereof. The enamel band 22 is shown as having a representative serial number 23 applied thereto. In one of the preferred embodiments of the present invention, the serial number 23 will comprise a discreet opaque layer of pigment 23A on top of the ceramic enamel band 22. In automotive applications, after application of the indicia 23, the substrate 20 is typically heated prior to bending into a desired shape, and it was the availability of this heating step which has contributed to the usefulness of the present invention.

Although the operation of the method of the present invention is not fully understood, it is believed that when the unfired black ceramic enamel band 22 is applied to a substrate 20, upon magnification hills and valleys would be seen in the unfired substrate 22. It is believed that these hills and valleys help capture the pigment 23A applied by the ink jet head 15, and permit the ink jet printing to be done with a high degree of resolution. It is further believed that, upon heating the windshield 21, the unfired ceramic enamel band 22 starts to soften and flow somewhat, thus reducing the hills and valleys. Substantially simultaneously, the frit or flux in the unfired ceramic enamel band becomes sticky and provides a surface to which the pigments in the ink can stick or adhere to, thus making for a permanent marking after the heating or curing step.

It is the use of this property that permits the novel use of a less expensive ink, i.e., one that does not have any frit or flux, but still provides a permanent marking by use of the heating step which is known in the manufacture of windshields. When the ink composition itself was printed on a clean glass surface it was found that it would not adhere after heating to 1200 degrees F. for four minutes. The ink composition must be printed on top of the black enamel band in order to remain after heating.

It was further found that the ink jet composition, if applied to the black ceramic enamel band 22 after bending of the windshield 21, would provide satisfactory temporary markings such as lot numbers, etc. which are useful for many purposes. This led to the use of the method of the present invention to provide a wide variety of temporary and permanent markings on automotive substrates, such as permanent markings on glass when the indicia are applied before heating and/or bending, and temporary markings, such as when the indica are applied to windshields after bending, or to automotive side lights such as polycarbonate, without heating.

The same considerations apply to applications to architectural substrates. Whether a substrate is to be bent or not, if a permanent marking is desired, the substrate needs to be heated to a temperature and for a time sufficient to cure the ink and make the marking permanent. The substrate is preferably heated to a temperature between about 1000° F. and about 1400° F. However a large of number of temporary markings can be applied to flat architectural glass having an enamel band if a marking of a temporary nature is desired.

A non-contact ink jet printer contemplated as useable for practicing the present invention is the Excel® 170i ultra high speed ink jet printer manufactured by Video Jet® Systems International Inc of Wooddale, Ill. Other non-contact ink jet printers may be used as long as they have the capability of using the inorganic inks required by the method of the present invention.

The ink compositions usable in the method of the present invention are those which contain a pigment and a vehicle. A wide range of pigment levels in the ink composition are possible in accordance with the invention, depending upon the particular ink jet printer used, and the desired appearance of the marking.

Undue clogging of the ink jet printer will likely result if the pigment concentration is too high. On the otherhand, depending upon the ink jet printer used, the marking may be undersirably light if the pigment concentration is too low. Preferably, the ink compositions used in the invention contain pigment in an amount from about 1% to 25%, and most preferably 5% to 10%.

The ink compositions also contain a suitable vehicle for the pigment, as is well known. Methanol and 2-butanone are preferred examples. The ink compositions may also contain other known additives, such as flow modifiers. The other components in the ink will depend upon the application. It is desired that the pigment in the ink jet composition contain titanium dioxide to provide the preferred white opaque layer on top of the black ceramic enamel band. However other pigments can be used if other colored markings are desired, or other color enamel bands are used.

A known ink jet composition having titanium dioxide pigments and meeting the other desired weight percentages of the preferred ink jet composition is a Video Jet® number 2520 ink supplied by Video Jet Systems International of Wooddale, Ill.

In operation, an ink jet composition of the present invention is applied at a temperature from about 70° F. to about 200° F. as a thin layer to the surface of an enamel band 22 in a predetermined pattern using a non-contact ink jet printer 10. Thereafter, the substrate 20 having the ink 23A thereon is heated to a temperature and for a time sufficient to cause the pigment particles to adhere or stick to the fluxes in the black enamel band 22.

The invention is more easily comprehended by reference to specific embodiments which are representative of the invention. It must be understood however that such specific examples are provided only for the purposes of illustration, and not of limitation, and that the invention may be practiced or carried out otherwise than as set forth in the examples and be well within the scope of the invention.

EXAMPLE I

A Video Jet® 2520 ink is applied to a black ceramic enamel band on a soda-lime-silica glass blank to be formed into a windshield. The composition of this ink is from about 3% to about 7% weight of 1-Methoxy-2-Propanol; from about 5% to about 10% by weight of Titanium Dioxide; from about 20% to about 35% by weight of Methanol; from about 0% to about 30% by weight acrylic resin; from about 20% to about 35% by weight of 2-Butanone; and from about 1% to about 3% weight of N-Methyl-2-Pyrrolidone. The ink is applied by a Video Jet® Excel 170i Ultra High Speed Ink Printer at a temperature of 75° F. After printing, the glass is heated to about 1200° F. for about four minutes. The ink jet printed mark becomes permanent because the white titania pigments in the ink jet composition have adhered to the fluxes in the black enamel band. The glass blank is then bent to form a windshield.

EXAMPLE II

A temporary marking is applied to a soda-lime-silica glass by applying a Video Jet® 2520 ink to the black enamel band on a windshield glass using a Video Jet® Excel 170i Ultra High Speed Ink Jet Printer after the glass has been bent to shape. In this case, the ink jet head 15 (FIG. 1) is moved by robotic arm 18 in a pattern which closely follows the curvature of the windshield 21.

EXAMPLE III

A temporary indicia is applied to a polycarbonate automotive side light by applying a 2520 ink jet composition made by Video Jet® Systems International, Inc. of Wooddale, Ill. to a black ceramic enamel band contained on the surface around the periphery of the side light.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A process for affixing indicia to a substrate comprising the steps of:

a) providing a substrate having an enamel band applied to at least one surface thereof;

b) applying to the enamel band in a pattern by a non-contact ink jet printing process an ink composition including an inorganic pigment, whereby indicia substantially conforming to the pattern supplied from a non-contact ink jet printer is affixed to the substrate.

2. The process defined in claim 1, and further including the step of:

a) heating the substrate having the ink thereon to a temperature and for a time sufficient to cause the inorganic pigment to adhere thereto.

3. The process defined in claim 2, and including the further step, subsequent to said heating step, of bending said substrate to a predetermined shape.

4. The process defined in claim 1, wherein the percentage by weight of said inorganic pigment in said ink is from about 5% to about 10% by weight.

5. The process defined in claim 4, wherein the ink is applied at a temperature from about 70° F. to about 200° F.

6. The process defined in claim 1, wherein said ink composition includes:

a) from about 0.5% to about 80% by weight of an inorganic pigment or mixture of inorganic pigments;

b) from about 20% to about 99.5% by weight of a vehicle; and c) from 0% to about 30% by weight of a resin.

7. The process defined in claim 1, and including the further steps of:

a) providing that said non-contact ink jet printer has an ink jet printing head for application of said ink composition and said ink jet head is mounted to a programmable robotic arm.

8. A process for affixing indicia and patterns to a polycarbonate glazing for automotive use, including the steps of:

a) providing a polycarbonate glazing; b) utilizing an ink jet printer to apply to the surface of the polycarbonate glazing in a predetermined pattern an ink jet composition comprising:

i) from about 0.5% to about 80% by weight of pigments, ii) from about 20% to about 95% by weight of a vehicle, and iii) from 0% to about 30% by weight of resin.

9. The process defined in claim 8, and including the further steps of:

a) providing that said ink jet printer has an ink jet printing head for application of said ink composition and said ink jet head is mounted to a programmable robotic arm.

10. A process for permanently affixing indicia to a soda-lime-silica glass windshield for automotive use, comprising the steps of:

a) providing a glazing including a surface having a frit containing black enamel band provided thereon;

b) utilizing an ink jet printer to apply to the black enamel band in a predetermined pattern an ink jet composition comprising:

i) from about 3% to about 7% by weight of 1-Methoxy-2-Propanol, ii) from about 5% to about 10% by weight of Titanium Dioxide, iii) from about 20% to about 35% by weight of Methanol, iv) from about 20% to about 35% by weight of 2-Butanone, and v) from about 1% to about 3% by weight of N-Methyl-2-Pyrrolidone, vi) from 0% to 30% acrylic resin, and c) firing said windshield having the enamel band and the ink thereon to a temperature and for a time sufficient to cause the pigments in the ink to adhere to the frit in the enamel band; and d) bending said windshield to a predetermined shape.

11. The process defined in claim 10, and including the further steps of:

a) providing that said ink jet printer has an ink jet printing head for application of said ink composition and said ink jet head is mounted to a programmable robotic arm.

12. A process for permanently affixing indicia to a glass sheet of the type having a frit containing enamel band applied to a surface thereof, said method including the steps of:

a) utilizing a non-contact ink jet printer to apply to said enamel band an ink composition including from about 5% by weight to about 10% by weight of titanium dioxide pigment at a temperature from about 70° F. to about 200° F.; and b) heating the glass article having the ink thereon to a temperature and for a time sufficient to cause the titanium dioxide pigment to adhere to the frit present in said enamel band.

13. The process defined in claim 12, and including the further steps of:

a) providing that said non-contact ink jet printer has an ink jet printing head for application of said ink composition and said ink jet head is mounted to a programmable robotic arm.

14. A process for permanently affixing indicia to a glass sheet, including the steps of:

a) providing a glass sheet, including a surface having a frit containing enamel band applied thereto;

b) utilizing a non-contact ink jet printer to apply to the surface in a predetermined pattern by contacting therewith droplets generated by said non-contact ink jet printer an ink composition comprising:

i) from about 3% to about 7% by weight of 1-Methoxy-2-Propanol, ii) from about 5% to about 10% by weight of Titanium Dioxide, iii) from about 20% to about 35% by weight of Methanol, iv) from about 20% to about 35% by weight of 2-Butanone, and v) from about 1% to about 3% by weight of N-Methyl-2-Pyrrolidone, vi) from 0% to 30% of acrylic resin, and c) heating the glass article having the enamel band and the ink thereon to a temperature and for a time sufficient to cause the pigment in the ink to adhere to the frit in the enamel band.

15. The process defined in claim 14, and including the further steps of:

a) providing that said non-contact ink jet printer has an ink jet printing head for application of said ink composition and said ink jet head is mounted to a programmable robotic arm.

16. A method for permanently affixing indicia to soda-lime-silica glass glazings for automotive or architectural use, including the steps of:

a) providing a glazing including a surface having a frit containing black enamel band provided thereon;

b) utilizing an ink jet printer to apply to the black enamel band in a predetermined pattern an ink jet composition comprising:

i) from about 3% to about 7% weight of 1-Methoxy-2-Propanol, ii) from about 5% to about 10% by weight of Titanium Dioxide, iii) from about 20% to about 35% by weight of Methanol, iv) from about 20% to about 35% by weight of 2-Butanone, and v) from about 1% to about 3% weight of N-Methyl-2-Pyrrolidone, vi) from 0% to 30% acrylic resin, and c) firing the glazing having the enamel band and the ink thereon to a temperature and for a time sufficient to cause the pigments in the ink to adhere to the frit in the enamel band.

17. The process defined in claim 16, and including the further steps of:

a) providing that said non-contact ink jet printer has an ink jet printing head for application of said ink composition and said ink jet head is mounted to a programmable robotic arm.

* * * * *

UNITED STATES PATENT AND TRADEMARK OFFICE

CERTIFICATE OF CORRECTION

PATENT NO. : 5,684,515

DATED : November 4, 1997

INVENTOR(S) : Anthony C. Ho

It is certified that error appears in the above-identified patent and that said Letters Patent is hereby corrected as shown below:

In column 7, claim 12, line 2, delete "OF THE TYPE".

Signed and Sealed this

Second Day of February, 1999

*Attest:*

*Attesting Officer*

*Acting Commissioner of Patents and Trademarks*